US011795623B2

(12) United States Patent
Sierra

(10) Patent No.: US 11,795,623 B2
(45) Date of Patent: Oct. 24, 2023

(54) ROLLED PRODUCTS FOR ONE HANDED DISPENSING

(71) Applicant: Kimberly-Clark Worldwide, Inc., Neenah, WI (US)

(72) Inventor: Benjamin Peter Sierra, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 248 days.

(21) Appl. No.: 17/419,768

(22) PCT Filed: Dec. 31, 2018

(86) PCT No.: PCT/US2018/068133
§ 371 (c)(1),
(2) Date: Jun. 30, 2021

(87) PCT Pub. No.: WO2020/142062
PCT Pub. Date: Jul. 9, 2020

(65) Prior Publication Data

US 2022/0081844 A1 Mar. 17, 2022

(51) Int. Cl.

| | |
|---|---|
| ***D21H 27/00*** | (2006.01) |
| ***A47K 10/16*** | (2006.01) |
| ***B65H 18/28*** | (2006.01) |

(52) U.S. Cl.
CPC ..... *D21H 27/005* (2013.01); *A47K 10/16* (2013.01); *B65H 18/28* (2013.01)

(58) Field of Classification Search
CPC .... D21H 27/005; D21H 27/002; D21H 25/00; D21H 27/30; A47K 10/16; B65H 18/28
See application file for complete search history.

(56) References Cited

U.S. PATENT DOCUMENTS

| | | | | |
|---|---|---|---|---|
| 5,562,964 | A | 10/1996 | Jones | |
| 5,704,566 | A | 1/1998 | Schutz et al. | |
| 6,010,090 | A | 1/2000 | Bushmaker et al. | |
| 6,838,040 | B2 | 1/2005 | Mlinar et al. | |
| 8,268,429 | B2 * | 9/2012 | McNeil | B32B 29/005 162/114 |
| 8,283,013 | B2 * | 10/2012 | Feldmann | B26F 1/22 162/114 |

(Continued)

FOREIGN PATENT DOCUMENTS

| | | | | |
|---|---|---|---|---|
| BR | 112021011543 | A2 * | 8/2021 | A47K 10/16 |
| CN | 102031725 | A | 4/2011 | |

(Continued)

*Primary Examiner* — Jose A Fortuna
(74) *Attorney, Agent, or Firm* — Kimberly-Clark Worldwide, Inc.

(57) ABSTRACT

The present invention provides rolled products, such as spirally wound rolls of bath tissue comprising a plurality of separably joined sheets, that may be repeatably and reliably dispensed by a user with a single hand. Single handed dispensing of the rolled products is facilitated by the web having a ratio of detach strength, typically having units of grams (g) to cross-machine direction (CD) tensile, having units of grams per 76.2 mm, of 0.65 or less, such as from about 0.10 to 0.65. In this manner rolled bath tissue products may have a CD tensile from about 400 to about 1,000 g/76.2 mm and a detach strength from about 100 to about 500 g.

17 Claims, 3 Drawing Sheets

(56) References Cited

U.S. PATENT DOCUMENTS 8,287,976 B2 * 10/2012 Hupp ..... B32B 29/005 162/114
8,443,725 B2 * 5/2013 McNeil ..... B26F 1/26 101/6
8,468,938 B2 * 6/2013 Redd ..... B26F 1/20 101/6
8,535,483 B2 * 9/2013 McNeil ..... D21F 11/008 162/362
8,757,058 B2 * 6/2014 Kien ..... B26F 1/22 101/23
8,763,523 B2 * 7/2014 McNeil ..... B26D 7/20 101/23
8,763,526 B2 * 7/2014 McNeil ..... B26F 1/26 493/320
9,259,848 B2 * 2/2016 Hupp ..... B65H 35/08
9,918,596 B2 * 3/2018 Olson ..... B31F 1/07
10,188,242 B2 * 1/2019 Olson ..... B65H 18/28
10,524,622 B2 * 1/2020 Olson ..... B32B 29/002
10,624,506 B2 * 4/2020 Olson ..... A47G 11/001
11,633,076 B2 * 4/2023 Mitchell ..... D21H 27/005 242/160.4
11,707,162 B2 * 7/2023 Olson ..... A47K 10/16 162/117
2007/0269627 A1 11/2007 Vinson et al.
2009/0155512 A1 6/2009 Neto et al.
2011/0308363 A1 * 12/2011 Kien ..... B26F 1/22 83/37
2011/0308366 A1 * 12/2011 Redd ..... B26F 1/22 83/345
2011/0308370 A1 * 12/2011 Hupp ..... B26F 1/20 83/665
2011/0308372 A1 * 12/2011 McNeil ..... B26F 1/20 83/886
2011/0308405 A1 * 12/2011 McNeil ..... B65H 35/02 101/24
2011/0308406 A1 * 12/2011 McNeil ..... B41J 3/407 101/32
2011/0308754 A1 * 12/2011 McNeil ..... D21F 11/008 162/286
2011/0309544 A1 * 12/2011 Hupp ..... B26F 1/24 264/156
2011/0311748 A1 * 12/2011 Hupp ..... B32B 5/26 428/43
2011/0311749 A1 * 12/2011 McNeil ..... D21H 27/02 428/43
2011/0311750 A1 * 12/2011 McNeil ..... B26F 1/24 428/43
2011/0311751 A1 * 12/2011 Feldmann ..... B26F 1/24 428/43
2016/0345761 A1 * 12/2016 Olson ..... A47G 11/001
2016/0345786 A1 * 12/2016 Olson ..... D21H 27/02
2017/0183825 A1 6/2017 Manifold et al.
2018/0132674 A1 * 5/2018 Olson ..... B65H 18/28
2018/0142419 A1 5/2018 Rouse et al.
2020/0129014 A1 * 4/2020 Mitchell ..... D21H 27/02
2022/0081844 A1 * 3/2022 Sierra ..... D21H 27/002
2023/0228037 A1 * 7/2023 Mitchell ..... D21H 27/005 482/43

FOREIGN PATENT DOCUMENTS

JP 2018527473 A * 9/2020 ..... D21H 25/00
WO 9721377 A1 6/1997
WO 2013093676 A1 6/2013

* cited by examiner

ROLLED PRODUCTS FOR ONE HANDED DISPENSING

BACKGROUND

Fibrous webs, such as tissue webs and more particularly bath tissue webs are often spirally wound about a core for easy dispensing. To facilitate dispensing the spirally wound webs are often further provided with spaced-apart lines of perforations which divide the wound web into useable units, often referred to in the art as "sheets." When a consumer uses the spirally wound roll, such as a roll of bath tissue, the user unwinds the desired number of "sheets" and tears the unwound sheet along the chosen line of perforations. While such rolls offer a great deal of flexibility in terms of the length of the web being dispensed, they can be inconvenient in that it takes two hands to dispense the web—one to hold the roll to keep it from unwinding while the other hand is used to grasp the exposed end of the web to pull and tear the web along the chosen line of perforations. Also, the perforations do not always function as desired and the web may tear irregularly.

Therefore there is a need for spirally wound fibrous webs, particularly tissue webs and more particularly bath tissue webs, that more easily and reliably dispense the desired number of sheets and are amenable to single handed dispensing.

SUMMARY

It has now been discovered that rolled products comprising spirally wound fibrous structures, such as tissue webs and more particularly perforated bath tissue webs, may be dispensed using a single hand by balancing the force required to separate individual sheets from one another, such as the force required to separate adjoined sheets along a line of perforations, and the physical properties of the sheet itself, such as the cross-machine direction (CD) tensile strength or machine direction (MD) tear. For example, in one embodiment the present invention provides a spirally wound tissue web amenable to single hand dispensing a perforated tissue web having a ratio of CD tensile, having units of grams (g) per 76.2 mm, to detach strength, having units of grams (g) of 0.65 or less, such as from about 0.10 to 0.65. By balancing the CD tensile strength and detach strength to provide a product having a ratio of detach strength to CD tensile of 0.65 or less, a user may reliably and repeatedly remove a length of material by unwinding the roll and dispensing the desired length of material with one hand.

In other embodiments the present invention provides methods and perforated web products having improved features which result in multiple advantages including enhanced dispensing reliability, lower manufacturing costs, greater flexibility, and higher perforation quality. Accordingly, in one embodiment the present invention provides a method of manufacturing a rolled bath tissue product comprising the steps of providing a tissue web having a CD tensile strength from about 300 to about 1,200 g/76.2 mm; disposing a line of weakness on the web; conveying the weakened web on a web transport apparatus to a winding module comprising a rotatable mandrel and a core disposed on the mandrel; contacting the web with the core to form a nip between the core and the web transport apparatus; and rotating the mandrel and the core to commence center winding of the web. The resulting rolled tissue product may have a detach strength of about 450 g or less, such as from about 200 to about 400 g and a ratio of detach strength to CD tensile of 0.65 or less, such as from about 0.30 to about 0.50.

In other embodiments the present invention provides a tissue product comprising a plurality of separably joined sheets, the product having a ratio of detach strength, having units of grams, to CD tensile, having units of grams per 76.2 mm, less than 0.65.

In another embodiment the present invention provides a tissue product comprising a plurality of separably joined sheets, the product having a tensile ratio from about 1.5 to about 2.0 and a ratio of detach strength, having units of grams, to CD tensile, having units of grams per 76.2 mm, from about 0.20 to 0.60.

In yet other embodiments the present invention provides a rolled product comprising a spirally wound fibrous web having one or more plies and a plurality of lines of perforations having a percent bonded area from about 10 to about 17.5 percent, the web having a ratio of detach strength, having units of grams, to CD tensile, having units of grams per 76.2 mm, equal to or less than 0.0862+3.223*percent bonded area.

In still other embodiments the present invention provides a tissue product comprising a plurality of separably joined sheets, the product having a machine-direction (MD) tear strength less than about 15 g, such as from about 10 to about 15 g, such as from about 10 to about 12.5 g and a ratio of detach strength, having units of grams (g), to MD tear strength, having units of grams (g), less than about 40, such as from about 20 to about 40 and more preferably from about 20 to about 30.

In another embodiment the present invention provides a rolled product comprising a spirally wound tissue web having one or more plies, a first side, a second side, a length, a width, and a plurality of lines of perforations spaced apart from one another along the length of the web, the lines of perforations each comprising a plurality of individual apertures extending substantially from the first to the second side and spaced apart from one another across the width of the web, the web having a CD tensile from about 400 to about 1,000 g/76.2 mm, a detach strength from about 100 to about 500 g and a ratio of detach strength to CD tensile less than 0.65.

In yet another embodiment the present invention provides a tissue product comprising a plurality of separably joined sheets, the product having a tensile ratio from about 1.5 to about 2.5, a machine direction (MD) tear strength from about 10 to about 15 and a ratio of detach strength, having units of grams, to CD tensile, having units of grams per 76.2 mm, less than 0.65.

DEFINITIONS

Figure 1:
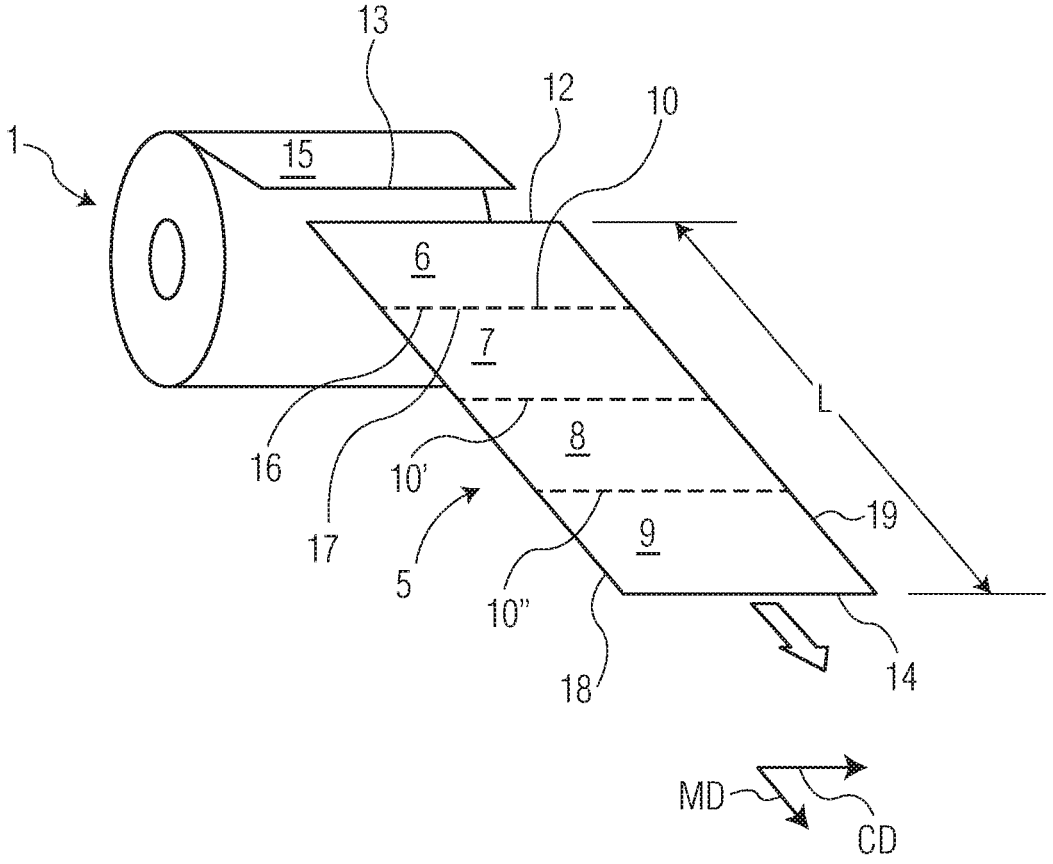
FIG. 1 is a schematic illustration of a roll of tissue product in accordance with this invention, illustrating the removal of an individual elongated sheet of a pre-determined length.

As used herein, the term "machine direction" (MD) generally refers the direction in which a fibrous structure, such as a tissue web, is manufactured or converted. The term "cross-machine direction" (CD) means the direction of a fibrous structure, such as a tissue web, that is substantially perpendicular to the MD.

As used herein, the term "fibrous structure" refers to a structure comprising a plurality of elongated particulate having a length to diameter ratio greater than about 10 such as, for example, papermaking fibers and more particularly pulp fibers, including both wood and non-wood pulp fibers, and synthetic staple fibers. A non-limiting example of a fibrous structure is a tissue web comprising pulp fibers.

As used herein the term "tissue web" refers to a fibrous structure provided in sheet form and being suitable for forming a tissue product. The tissue web may be formed by any one of the papermaking processes described herein. In certain instances a tissue web comprises a fibrous structure provided in sheet form that has not been subjected to further processing, such as embossing, calendering, perforating, plying, folding, or spiral winding about a core, to convert the sheet into a finished product.

As used herein the term "tissue product" refers to a finished product salable to a consumer made from a tissue web. Non-limiting examples of tissue products include bath tissue, facial tissue, paper towels, industrial wipers, food-service wipers, napkins and medical pads. Tissue products may comprise one, two, three or more plies and may have a basis weight from about 10 to about 100 grams per square meter (gsm) and a sheet bulk greater than about 3 cubic centimeters per gram (cc/g), such as from about 3 to about 30 cc/g and more preferably from about 5 to about 25 cc/g.

As used herein, the term "basis weight" generally refers to the bone dry weight per unit area of a fibrous structure and is generally expressed as grams per square meter (gsm). Basis weight is measured using TAPPI test method T-220.

As used herein, the term "separably joined" generally refers to adjacent sheets within a continuous web that may be separated from one another along a line of weakness.

As used herein, the term "line of weakness" generally refers to a portion of a web that is more readily ruptured, or torn, upon application of a tearing force to the web. The lines of weakness may be suitably formed by mechanical cutting, pressure cutting, ultrasonic cutting, thermal deformation, mechanical thinning or other suitable techniques. As an example, with reference to FIG. 1, the line of weakness may be in the form of a line of perforations 10 comprising a plurality of cuts 16 spaced apart from one another by bonds 17 and extending in the CD from a first edge 18 to second edge 19.

Each line of weakness can pass partially or completely through the thickness of the fibrous structure, web or sheet, as the case may be. Each line of weakness can also be either linear or non-linear in shape or configuration within the scope of this invention. Non-linear shapes can include curved or arcuate profiles, a saw tooth profile, a zigzag profile, a sinusoidal profile, or any other geometrical profile that is not a straight line.

As used herein, the term "perforation" generally refers to one or more holes, slits, apertures, voids, or the like, or combinations thereof through a fibrous structure to facilitate separation of one portion of the structure from another. For example, a perforation may be a portion of a tissue web that has been mechanically severed. Perforations may be disposed on a tissue web to provide sheets that are separably joined. In certain embodiments the perforations may comprise a linear set of apertures generally extending in one dimension of the web, such as the CD, which may be described as a line of perforations. In other embodiments the line of perforations may be non-linear.

As used herein, the terms "bond length" refers to the length of a nonperforated segment of the web in the line of perforations. Said another way, it is the distance between adjacent perforations. Perforations that are useful with sheets of the invention may have a bond length in the range from about 0.40 to about 1.0 mm, such as from about 0.50 to about 0.90 mm. The foregoing are non-limiting and the as the perforation configuration is dependent upon many factors including base sheet characteristics (e.g., fiber composition, formation process, bulk, density, thickness, weight, CD tensile, MD tensile), operating conditions, such as log winding speeds and tensions, and others that can affect how one sheet separates from another sheet and/or dispenses from a dispenser.

As used herein, the term "percent bonded area" is equal to:

$$\frac{NumberofBonds \times BondLength\ (\text{mm})}{Sheetwidth\ (\text{mm})}$$

Perforations that are useful with sheets of the invention may have a percent bonded area from about 10 to about 25 percent, such as from about 12 to about 20 percent.

As used herein, the term "detach strength" refers to the force in grams (g) per sheet that is required to break the line of weakness. In one non-limiting example the detach strength may be the force in grams (g) per sheet that is required to separate two sheets in a tissue web spirally wound into a roll along a line of perforations. Detach strength is measured as described in the Test Methods section below.

As used herein, the term "cross-machine direction tensile" (CD tensile) refers to the cross-machine direction tensile strength of a fibrous structure measured as set forth in the Test Method section below. While the CD tensile may vary, in certain embodiments tissue products prepared according to present invention may have a CD tensile greater than about 300 g/76.2 mm, such as greater than about 400 g/76.2 mm, such as from about 300 to about 1,200 g/76.2 mm, such as from about 400 to about 1,000 g/76.2 mm, such as from about 500 to about 900 g/76.2 mm.

As used herein, the term "geometric mean tensile" (GMT) refers to the square root of the product of the machine direction tensile strength and the cross-machine direction tensile strength of a fibrous structure measured as set forth in the Test Method section below. While the GMT may vary, in certain embodiments tissue products prepared according to the present invention may have a GMT greater than about 500 g/76.2 mm, such as greater than about 750 g/76.2 mm, such as from about 500 to about 3,000 g/76.2 mm. In particularly preferred embodiments the invention provides rolled bath tissue products having a GMT from about 700 to about 1,500 g/76.2 mm, such as from about 700 to about 1,200 g/76.2 mm.

As used herein the term "tensile ratio" generally refers to the ratio of machine direction (MD) tensile (having units of g/76.2 mm) and the cross-machine direction (CD) tensile (having units of g/76.2 mm). While the tensile ratio for a given fibrous structure prepared according to the present invention, in certain embodiments, products may have a tensile ratio of about 2.0 or less, such as from about 1.0 to about 2.0, such as from about 1.5 to about 2.0, such as from about 1.8 to about 2.0.

As used herein the term "tear strength" generally refers to the force required to tear a tissue product as measured according to TAPPI test method T-414 and described in the test methods section below. Tear strength is directional and MD and CD tear are measured independently.

DETAILED DESCRIPTION

The present invention provides fibrous structures, particularly fibrous webs and more particularly tissue webs comprising a plurality of separably joined sheets. The physical properties of the fibrous structure, such as tensile strength and more particularly cross-machine direction (CD) tensile strength, are balanced with the force required to separate separably joined sheets from one another, often referred to as the detach strength. By balancing tensile strength and detach strength the present invention provides fibrous structures, particularly tissue webs comprising a plurality of separably joined sheets, that may be dispensed using a single hand. That is, a user may use a single hand to both unroll a desired length of sheets from a roll of tissue product and then separate the length of sheets from the roll.

To achieve the desired single hand dispensing, in certain embodiments, it may desirable to provide a tissue product having a ratio of detach strength, having units of grams (g) to cross-machine direction (CD) tensile, having units of grams per 76.2 mm (g/76.2 mm), of 0.65 or less, such as from about 0.10 to 0.65. For example, the tissue product may comprise a spirally wound fibrous web having one or more plies, a first side, a second side, a length and a width, and a plurality of lines of perforations spaced apart from one another along the length of the web, the web having a CD tensile from about 400 to about 1,000 g/76.2 mm and a detach strength from about 100 to about 500 g, wherein the ratio of detach strength to CD tensile is less than 0.65.

In other embodiments single hand dispensing may be achieved by providing a tissue product comprising a plurality of separably joined sheets, the product having a machine direction (MD) tear from about 10 to about 15 grams (g), such as from about 10 to about 12.5 gf, and a ratio of detach strength, having units of grams, to MD tear less than 40, such as from about 20 to about 40, such as from about 20 to about 35.

With reference now to FIG. 1, the invention will be described in greater detail. For purposes herein, like reference numbers in the various figures refer to like features. Shown in FIG. 1 is a roll of bath tissue product 1 in accordance with this invention being unwound in the direction of the arrow. A detached elongated portion 5 has a pre-determined length "L" as measured between two ends 12 and 14. The elongated portion 5 can be used "as is", or it can be subdivided into individual sheets 6, 7, 8 and 9 by the consumer if desired. For bath tissue an elongated portion 5 may have a length "L" that is the equivalent of two, three, four, five or more conventional individual sheets. In certain instances "L" can be about 40 centimeters or greater, more particularly from about 40 to about 100 centimeters, depending on the user preferences and the particular product form.

In the embodiment shown, the elongated portion 5 is subdivided into four "sheets" 6, 7, 8 and 9 by lines of perforations 10, 10' and 10". The lines of perforations 10, 10' and 10" each comprise cuts 16 and bonds 17 resulting from mechanical severing of the elongated sheet 5 during converting. The lines of perforations 10, 10' and 10" define individual sheets 6, 7, 8, and 9, which are separably joined. The lines of perforations 10, 10' and 10" are spaced apart from another in the machine direction (MD) and are generally linear and extend from a lateral first edge 18 to a lateral second edge 19 across the cross-machine direction (CD). In other embodiments the lines of perforations may be non-linear. In still other embodiments the lines of perforations may only extend partially across the CD of the web.

Figure 2:
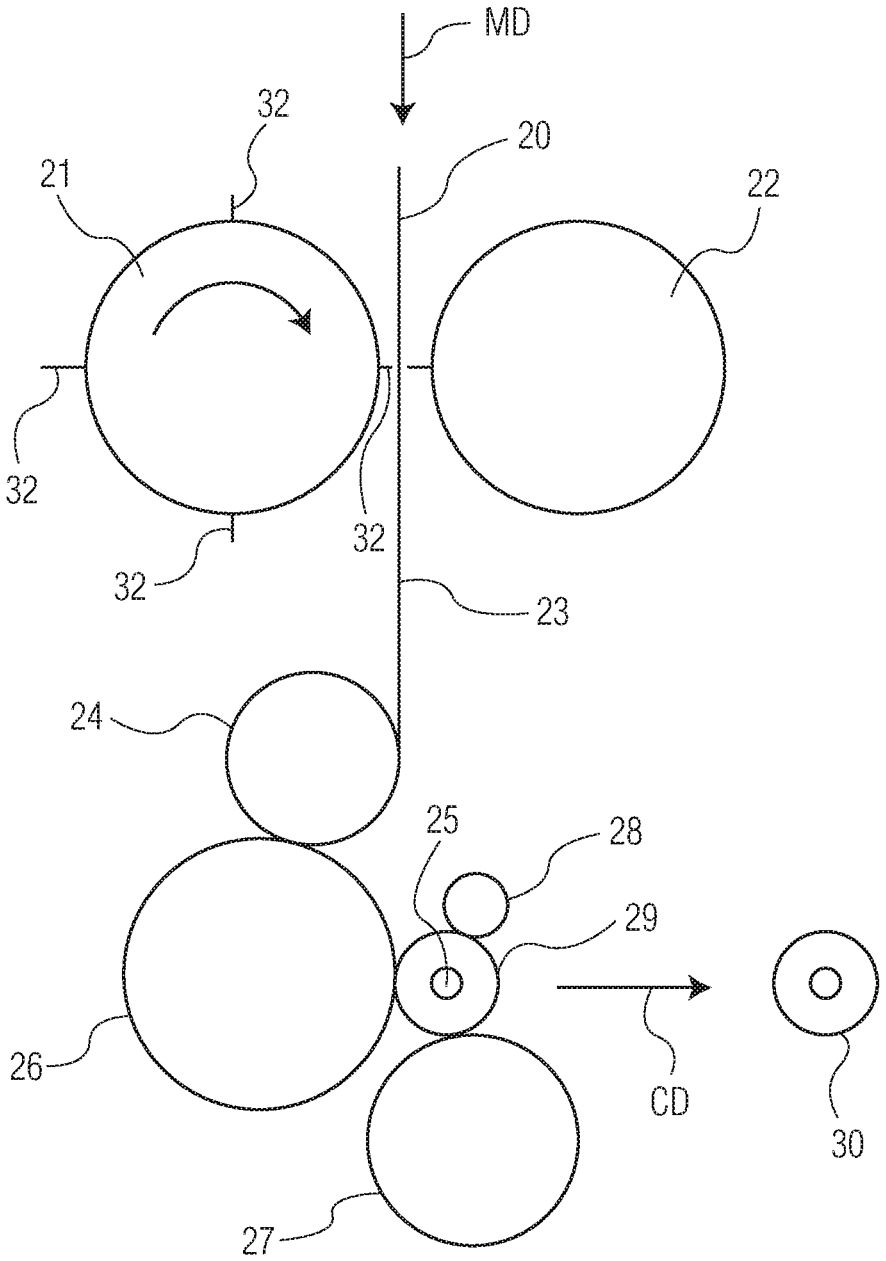
FIG. 2 is a schematic illustration of the converting process in which a tissue base sheet from a parent roll is provided with lines of perforations, wound into logs, and thereafter sliced into individual rolls of tissue product.

Turning now to FIG. 2, which schematically illustrates one embodiment for converting rolled tissue product according to the present invention, a tissue base sheet 20 is fed into a nip between a perforator roll 21 and a stationary anvil roll 22. The perforated roll 21 comprises one or more perforating blades 32 radially spaced about the circumference of the roll. The spacing of the perforating blades 32 around the circumference of the perforator roll 21 will determine the machine direction spacing between lines of perforations. If additional lines of perforations between the lines of severance are needed, the number of blades on the perforator roll can correspondingly be increased. Alternatively, an additional pair of a perforator roll and an anvil roll can be used if more lines are desired that cannot conveniently be provided by a single pair.

After the base sheet has been provided with the desired lines of perforations, the perforated base sheet 23 is passed around detour roll 24 and wound onto a core 25, assisted by upper winding drum 26, lower winding drum 27 and rider roll 28, to produce a log 29. Once the desired sheet count on the log is reached, the log diameter being the same as the diameter of the final product, the base sheet is severed and the resulting loose end of the perforated base sheet is tail-tacked (adhered) to the log in a conventional manner. The completed log 30 is then cut or sliced into multiple rolls of tissue product.

In another embodiment a roll of tissue product according to the present invention may be produced using a winding apparatus that combines both center and surface winding of the web onto a core, such as that disclosed in U.S. Pat. No. 8,210,462, the contents of which are incorporated herein in a manner consistent with the present disclosure. For example, a rolled tissue product may be manufactured using an apparatus comprising a perforating module for providing lines of weakness to a web and a winding module having a rotating mandrel that engages the leading edge of a moving web as it conveyed on a transport apparatus, such as a moving belt, or the like. The driven mandrel allows for center winding of the web in order to produce a low density, softer rolled product. The web transport apparatus allows for surface winding of the web and the production of a high density, harder wound rolled product. Further the web transport apparatus supports the web during the winding operation, eliminating the need for an open draw that might otherwise cause a perforated web having relatively low detach strength to be severed during the winding operation.

To wind the roll, the web is passed through a perforating apparatus to provide the web with spaced apart lines of weakness. The web is then transported on a web transport apparatus to a winding module and surface winding is induced by the contact between the core and the web to form a nip between the core and the web transport apparatus. Once started, the nip will be formed between the rolled product as it is built and the web transport apparatus. In this manner the winder allows for both center winding and surface winding in order to produce rolled products. In addition, a combination of center winding and surface winding may be utilized in order to produce a rolled product having varying characteristics. For instance, winding of the web may be affected in part by rotation of the mandrel (center winding) and in part by nip pressure applied by the positioning apparatus onto the web (surface winding).

In the foregoing embodiments the perforating blade is provided with a plurality of spaced notches that define and form a plurality of spaced cutting edges that are presented to the anvil. The width of the notches and cutting edges can be altered to provide a greater or lesser amount of cut material and a corresponding greater or lesser weakening of the web. In addition, the knife edge can be made with varying thicknesses which define the width of the opening, or can be formed as a die cutter, with the cutting edges having one or more various cross-sections, including without limitation a diamond cut, a round cut, etc. Preferably, the knife has a length equal to or greater than the length of the line of weakness. The knives are preferably made of tool steel, although other materials would also work.

In one preferred embodiment, the perforation knife is about 11.5 cm long and has between about 10 to about 30 notches spaced there along, where the notches have a length from about 0.40 to about 1.0 mm, such as from about 0.50 to about 0.90 mm. The cutting edges formed between the notches are preferably between about 8.0 to about 9.5 mm wide, such as from about 8.5 to about 9.0 mm wide. The foregoing dimensions are merely illustrative and are not intended to limit the scope of the invention. Ultimately, desired perforation configurations is dependent upon many factors including base sheet characteristics (e.g., fiber composition, formation process, bulk, density, thickness, weight, CD tensile, MD tensile), operating conditions, such as log winding speeds and tensions and others that can affect how one sheet separates from another sheet and/or dispenses from a dispenser.

In certain embodiments the notch and cutting edge lengths are uniform across the perforation knife. In other embodiments the lengths may vary, such as described in U.S. Pat. No. 6,368,689. Various preferred embodiments of 11.5 cm knife blades useful in the present invention and the resulting perforated tissue web, having a width of about 100 mm, are listed below in Table 1, below.

TABLE 1

| Embodiment | Notch Width (mm) | Number of Notches | % Bonded Area |
|---|---|---|---|
| 1 | 0.89 | 16 | 12.4 |
| 2 | 0.44 | 32 | 12.4 |
| 3 | 0.89 | 23 | 17.9 |
| 4 | 0.89 | 32 | 24.8 |

While the embodiment illustrated in FIG. 2 employs a perforator having a knife roll 21 and an anvil roll 22 to form a line of weakness, the invention is not so limited and an alternate weakening apparatus may be used. For example, the weakening apparatus can be configured with a laser, water jet, or other types of cutters known in the art. In other alternative embodiments, the weakening apparatus can comprise a device for applying heat, thermal energy or ultrasonic energy to the web so as to weaken it at specific locations, or lines of weakness. In other preferred embodiments, the weakening apparatus can include a chemical applicator that applies various chemicals, including for example water, to the web to weaken it at specific locations. In yet another alternative embodiment, the apparatus applies a speed differential to the web so as to weaken the web. Of course, it should be understood that the weakening apparatus can also be configured from combinations of one or more of the above-referenced devices.

For example, in an alternate embodiment the weakening apparatus may comprise a mechanical perforator, such as that illustrated in FIG. 2, in combination with a chemical applicator that applies a liquid weakener to the web. The mechanical perforator may perforate the web at each of a plurality of discrete locations extending generally in a cross-machine direction of the web. The chemical applicator prints a liquid weakener onto the web in locations extending generally in a cross-machine direction of the web. In one non-limiting alternative to the foregoing, the liquid printing device can be located and supplied with a liquid weakener to print the liquid weakener onto the web either before (i.e., in front of) or after (i.e., behind) where the web has been mechanically perforated, or even to print the liquid weakener between each of the mechanical perforations, or entirely across the area where the mechanical perforations are formed, or even in front of or behind each of the discrete locations where the web has been mechanically perforated. With this arrangement, the mechanical perforator may mechanically perforate the web and the liquid printing device may print the liquid weakener onto the web to thereby form perforations in the web.

In one non-limiting embodiment, the liquid printing device may print the liquid weakener onto the web in each of the discrete locations where the web has been perforated by the mechanical perforator, and the mechanical perforator can be located upstream of the liquid printing device so the liquid printing device can print the liquid weakener after the web has been mechanically perforated to form enhanced perforations. From the foregoing, it will be appreciated that the web may be provided with two distinct forms of perforations, i.e., mechanical perforations and liquid perforations, or it may be provided with mechanical perforations that are enhanced as a result of printing a liquid weakener onto the mechanical perforations, between the mechanical perforations, across the area of the mechanical perforations, before the mechanical perforations or after the mechanical perforations.

A wide variety of fibrous structures are useful in the present invention, including wet and dry laid webs. In one particularly preferred embodiment the web is a wet laid tissue web. Suitable tissue webs may be produced using any one of several well-known wet laid processes. Generally the wet laid process comprises feeding fiber dispersed in water into a paper machine, combining the fibers with the chemicals appropriate for the type of product being produced, e.g., wet strength resins for the production of a kitchen towel, depositing the fiber onto a system of fabrics to form a sheet and drying the sheet. Drying may be accomplished by any known papermaking process, for example, by Yankee dryer, through-air-drying, or any process using a structured drying fabric, including by way of example, the UCTAD process, the eTAD process, the Atmos process, and the like.

In other embodiments fibrous structures useful in the present invention may be made by air-laying fiber. According to this process, fibers are entrained in an air stream and collected on a condenser screen. The sheet deposited on the condenser screen can be bonded by any suitable method including, for example, mechanical bonding, e.g., needle punching, thermal bonding, chemical bonding, hydroentanglement, and the like. As with wet laid paper sheets, air-laid nonwovens are subjected to converting operations to transform the base sheet into the desired end product.

Regardless of the process by which it is made, the fibrous structure will generally have different physical properties, such as tensile strength, in the machine and cross-machine direction. For example, the MD tensile may be greater than the CD tensile such that the tensile ratio is about 2.0. In other embodiments the tensile ratio may range from about 1.2 to about 2.0, such as from about 1.5 to about 2.0, such as from about 1.8 to about 2.0. In certain embodiments products produced according to the present invention may have a MD tensile greater of about 800 g/76.2 or greater, such as from about 800 to about 2,000 g/76.2 mm, such as from about 1,000 to about 1,750 g/76.2 mm. The CD tensile is generally less than the MD tensile and may range from about from about 300 to about 1,200 g/76.2 mm, such as from about 400 to about 1,000 g/76.2 mm, such as from about 500 to about 900 g/76.2 mm.

In one embodiment the present invention comprises a rolled bath tissue product having a tensile ratio of about 2.0 or less, such as from about 1.2 to about 2.0, and a GMT from about 700 to about 1,500 g/76.2 mm, such as from about 700 to about 1,200 g/76.2 mm and a CD tensile from about 300 to about 1,200 g/76.2 mm, such as from about 400 to about 1,000 g/76.2 mm, such as from about 500 to about 900 g/76.2 mm. The bath tissue product may further have a sheet bulk greater than about 3 cc/g, such as from about 3 to about 25 cc/g and a basis weight from about 10 to about 50 gsm, such as from about 15 to about 45 gsm.

In addition to winding and weakening as described above, webs of the present invention may be subjected to other converting processes commonly used in the manufacture of tissue products such as cutting, folding, embossing, slitting, plying, laminating, chemically treating, and the like. Specific combinations of converting operations are well understood to produce certain end products. In one exemplary converting operation a wet laid tissue web may be unwound, embossed, plied, perforated, rewound, and cut into individual rolled bath tissue products. During these (and any other) operations, the sheet is moved at high speeds between various pieces of converting equipment.

The webs of the present invention, which have repeating lines of weakness, are preferably manufactured such that lines of weakness are sufficiently strong to maintain the integrity of the web during converting, but weak enough to separate a selected sheet from the remainder of the rolled product in use. Accordingly, the fibrous structures of the present invention may have a detach strength of about 600 g or less, such as from about 100 to about 600 g, such as from about 200 to about 500 g, such as from about 250 to about 450 g.

In certain instances the detach strength may be normalized based on the width of the sheet, that is grams (g) force per sheet divided by the width of the sheet, typically having units of millimeters (mm), to determine the "normalized detach strength." Webs useful in the present invention may be bath tissue webs having a width of from about 80 to about 120 mm, such as from about 90 to about 110 mm, and a normalized detach strength of about 7.5 or less, such as from about 2.0 to about 7.5, such as from about 2.5 to about 5.0, such as from about 3.0 to about 4.0. The foregoing tissue webs may further have a CD tensile from about 300 to about 1,200 g/76.2 mm, such as from about 400 to about 1,000 g/76.2 mm, such as from about 500 to about 900 g/76.2 mm.

As discussed previously, applicant has discovered that the dispensing of rolled tissue products can be evaluated from the perspective of a ratio of particular dispensing characteristics, rather than just one characteristic or another. As such, evaluating a ratio of certain characteristics may be predicative of dispensing efficacy. For example, to provide optimal one handed dispensing the ratio of detach strength, having units of grams (g), to MD tear strength, having units of grams (g), less than about 40, such as from about 20 to about 40 and more preferably from about 20 to about 30. Accordingly, in certain embodiments the invention provides a tissue product comprising a plurality of separably joined sheets, the product having a MD tear strength less than about 15 g, such as from about 10 to about 15 g, such as from about 10 to about 12.5 g and a ratio of detach strength, having units of grams (g), to MD tear strength, having units of grams (g), less than about 40, such as from about 20 to about 40 and more preferably from about 20 to about 30.

In certain embodiments the detach strength and MD tear strength may be balanced, such that the ratio of detach strength, having units of grams (g), to MD tear strength, having units of grams (g), is less than about 40, such as from about 20 to about 40 and more preferably from about 20 to about 30 and the sheet may further have a MD:CD tensile ratio greater than about 1.5 and more preferably greater than about 1.75 and still more preferably about 2.0 or greater, such as from about 1.5 to about 2.5 and more preferably from about 1.75 to about 2.25.

In other embodiments, to facilitate repeatable and reliable one handed dispensing of a rolled tissue product, the product may have a ratio of detach strength, having units of grams, to CD tensile, having units of grams per 76.2 mm, less than 0.65. For example, in certain embodiments the present invention provides tissue product comprising a plurality of separably joined sheets, the product having a cross-machine direction (CD) tensile less than about 1,000 g/76.2 mm, and a ratio of detach strength, having units of grams, to CD tensile less than 0.65.

Figure 3:
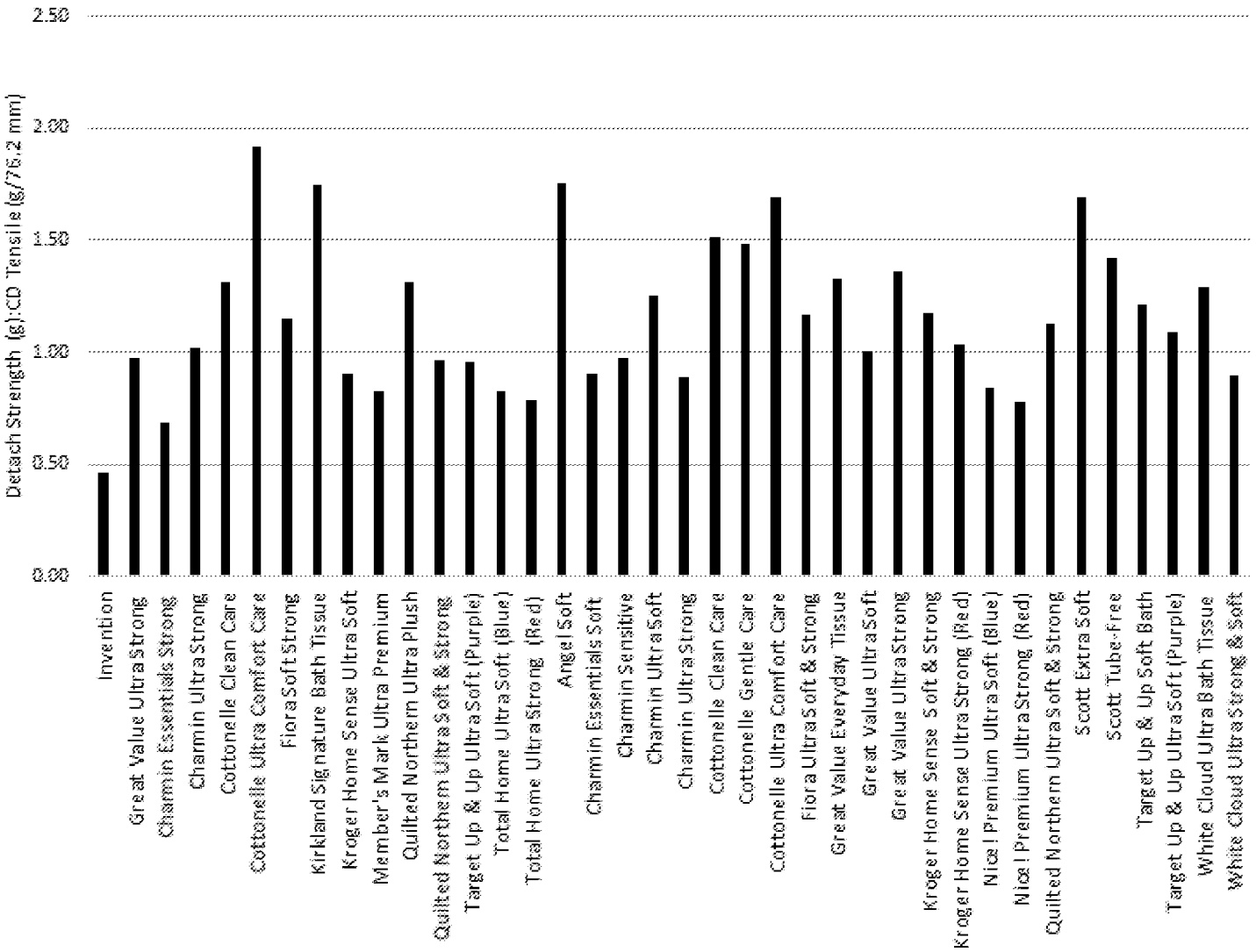
FIG. 3 illustrates the ratio of detach strength (g) to CD tensile (g/76.2 mm) for commercially available and inventive tissue products.

Accordingly, products prepared according to the present invention may have a detach strength to CD tensile ratio of 0.65 or less, such as from about 0.10 to 0.65, such as from about 0.25 to about 0.60, such as from about 0.30 to about 0.55, where detach strength has units of grams and CD tensile has units of grams per 76.2 mm. The foregoing ratio of detach strength to CD tensile are lower than those of commercially available tissue products, as summarized in Table 2, below and as illustrated in FIG. 3.

TABLE 2

| Product | Detach Strength (g) | CD Tensile (g/76.2 mm) | Detach: CD Tensile |
|---|---|---|---|
| Invention | 264 | 575 | 0.46 |
| Angel Soft | 709 | 404 | 1.76 |
| Charmin Essentials Soft | 616 | 683 | 0.9 |
| Charmin Essentials Strong | 547 | 800 | 0.68 |
| Charmin Sensitive | 581 | 596 | 0.98 |
| Charmin Ultra Soft | 617 | 494 | 1.25 |
| Charmin Ultra Strong | 676 | 759 | 0.89 |
| Cottonelle Clean Care | 881 | 580 | 1.52 |
| Cottonelle Gentle Care | 760 | 511 | 1.49 |
| Cottonelle Ultra Comfort Care | 1145 | 677 | 1.69 |
| Fiora Soft Strong | 633 | 550 | 1.15 |
| Fiora Ultra Soft & Strong | 619 | 530 | 1.17 |
| Great Value Everyday Tissue | 765 | 576 | 1.33 |
| Great Value Ultra Soft | 848 | 844 | 1.00 |
| Great Value Ultra Strong | 966 | 711 | 1.36 |
| Kirkland Signature Bath Tissue | 778 | 444 | 1.75 |
| Kroger Home Sense Soft & Strong | 802 | 683 | 1.18 |
| Kroger Home Sense Ultra Soft | 715 | 793 | 0.9 |
| Kroger Home Sense Ultra Strong (Red) | 872 | 841 | 1.04 |
| Member's Mark Ultra Premium | 721 | 871 | 0.83 |
| Nice! Premium Ultra Soft (Blue) | 710 | 844 | 0.84 |
| Nice! Premium Ultra Strong (Red) | 748 | 958 | 0.78 |
| Quilted Northern Ultra Plush | 526 | 401 | 1.31 |
| Quilted Northern Ultra Soft & Strong | 600 | 623 | 0.96 |
| Scott Extra Soft | 774 | 458 | 1.69 |
| Scott Tube-Free | 1122 | 787 | 1.43 |
| Target Up & Up Soft Bath | 763 | 629 | 1.21 |
| Target Up & Up Ultra Soft (Purple) | 801 | 834 | 0.96 |
| Total Home Ultra Soft (Blue) | 664 | 804 | 0.83 |
| Total Home Ultra Strong (Red) | 725 | 917 | 0.79 |

TABLE 2-continued

| Product | Detach Strength (g) | CD Tensile (g/76.2 mm) | Detach: CD Tensile |
|---|---|---|---|
| White Cloud Ultra Bath Tissue | 969 | 749 | 1.29 |
| White Cloud Ultra Strong & Soft | 913 | 1021 | 0.89 |

Accordingly, in a particularly preferred embodiment the present invention provides a rolled bath tissue product comprising a web having a plurality of lines of weakness spirally wound about a core, where the detach strength is balanced with the CD tensile of the web to facilitate one handed dispensing of the web from a roll. For example, one handed dispensing of a spirally wound perforated web may be accomplished repeatedly and reliably by providing a perforated web having a ratio of detach strength, having units of grams to cross-machine direction (CD) tensile, having units of grams per 76.2 mm (g/76.2 mm) of 0.65 or less, and more preferably about 0.60 or less, such as from about 0.10 to 0.65, such as from about 0.25 to about 0.60, such as from about 0.30 to about 0.55. In a particularly preferred embodiment the detach strength is less than about 400 g, the CD tensile strength is less than about 700 g/76.2 mm and the ratio of detach strength to CD tensile is less than 0.55.

In other embodiments the invention provides a perforated tissue web where the percent bonded ranges from about 10 to about 17.5 percent and the web has a ratio of detach strength, having units of grams, to cross-machine direction (CD) tensile, having units of grams per 76.2 mm (g/76.2 mm) equal to or less than 0.0862+3.223 percent bonded area. In the foregoing embodiment the ratio of detach strength to CD tensile, may range from about 0.10 to 0.65 and the web may have a tensile ratio from about 1.75 to about 2.0.

In still other embodiments the present invention provides a single-ply through-air dried rolled bath product having a detach strength value of about 500 g or less, more preferably less than about 450 g and still more preferably less than about 400 g, such as from about 200 to about 500 g. A two-ply through-air dried rolled bath product of the present invention may have a detach strength value of about 600 g or less, more preferably less than about 500 g and still more preferably less than about 400 g, such as from about 200 to about 600 g. In certain instances, the foregoing tissue products may have a ratio of detach strength, having units of grams (g), to cross-machine direction (CD) tensile, having units of grams per 76.2 mm (g/76.2 mm), of 0.65 or less, such as from about 0.10 to 0.65, such as from about 0.25 to about 0.60, such as from about 0.30 to about 0.55.

Test Methods

Sheet Bulk

Sheet Bulk is calculated as the quotient of the dry sheet caliper (μm) divided by the bone dry basis weight (gsm). Dry sheet caliper is the measurement of the thickness of a single sheet of tissue product (comprising all plies) measured in accordance with TAPPI test method 1402 using a ProGage 500 Thickness Tester (Thwing-Albert Instrument Company, West Berlin, NJ). The micrometer has an anvil diameter of 2.22 inches (56.4 mm) and an anvil pressure of 132 grams per square inch (per 6.45 square centimeters) (2.0 kPa).

Detach Strength

Detach strength was measured using an MTS Systems Sintech 11S, Serial No. 6233. The data acquisition software was an MTS TestWorks® for Windows Ver. 3.10 (MTS Systems Corp., Research Triangle Park, NC). For each measurement, two sheets were removed from a roll. The two sheets were separably joined by a line of perforations. The sheets were folded in half along their length. The top and bottom of the sample along substantially the entire width were placed in grips having an internal spacing of 2 inches (50.8 mm), such that the perforation line was centered between the upper and lower grips. The upper grip was then displaced upward (i.e. away from the lower grip) at a rate of 10 inches/minute (254.0 mm/min) until the sample was broken along the perforations. The applied force and sample elongation were measured throughout the test. The peak load from the force-elongation curve is recorded so that the detach strength is expressed as force in units of grams/sheet. The average results from ten samples are reported as the detach strength having units of grams (g).

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches (76.2 mm). More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, PA, Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, NC). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on the direction of the sample being tested. Ten representative specimens were tested for each product or sheet and the arithmetic average of all individual specimen tests was recorded as the appropriate MD or CD tensile strength of the product or sheet in units of grams of force per 3 inches (76.2 mm) of sample. The geometric mean tensile (GMT) strength was calculated and is expressed as grams-force per 3 inches (76.2 mm) of sample width.

Multi-ply products were tested as multi-ply products and results represent the tensile strength of the total product. For example, a two-ply product was tested as a two-ply product and recorded as such.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue base sheet such that the test specimen measures 63 mm±0.15 mm (2.5 inches±0.006 inch) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the proscribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For base sheets intended to be multiple ply products, the tear results are reported as the tear of the multiple ply product and not the single ply base sheet. This is done by multiplying the single ply base sheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

EXAMPLE

A single-ply uncapped through-air dried tissue web, prepared substantially as described in U.S. Pat. No. 5,607,551, and having a target basis weight of about 42.5 gsm and a target GMT of about 1150 g/76.2 mm was converted substantially as illustrated in FIG. 2. The sheet comprised a three layered sheet comprising bleached hardwood kraft fiber in the two outer most layers (comprising 65 wt %) and bleached northern softwood kraft (comprising 35 wt %) in the center layer. The sheets had a width of about 100 mm and lines of perforations were spaced apart from one another in the machine direction about 105 mm. The lines of perforations were imparted using one of four perforation blades having a width of 11.43 cm and bond patterns as detailed in Table 3, below.

TABLE 3

| Sample No. | Notch Width (mm) | Number of Notches | % Bonded Area |
|---|---|---|---|
| 1 | 0.89 | 16 | 12.4 |
| 2 | 0.89 | 30 | 23.3 |
| 3 | 0.89 | 47 | 36.6 |
| 4 | 0.89 | 65 | 50.6 |

The finished rolled bath tissue products were assessed for ease of one handed dispensing and dispensing failures. The physical properties of the products, such as CD tensile strength and detach strength were also measured. Dispensing failures, generally defined as breaking of a sheet in a direction other than along the lines of perforations, were determined for two different modes—two handed and one handed. For two handed dispensing a user was instructed to hold a roll, which was supported by a spindle, with their non-dominant hand, and with their dominant hand grasp the free sheet end near the perforation (approximately 1 inch from the perforation) and dispense the tissue by moving their dominant hand across their body. For one handed dispensing a user was instructed to grasp the free sheet end near the perforation (approximately 1 inch from the perforation) with their dominant hand and dispense the tissue by moving their dominant hand across their body. The results of the dispensing and physical testing are reported in Table 4, below.

TABLE 4

| Sample No. | GMT (g/76.2 mm) | MD:CD Tensile Ratio | MD Tear (g) | CD Tensile (g/76.2 mm) | Detach Strength (g) | Detach: CD Tensile | Two Handed Dispensing Failures (%) | One Handed Dispensing Failures (%) |
|---|---|---|---|---|---|---|---|---|
| 1 | 814 | 2.00 | 13.6 | 575 | 264 | 0.46 | 15.7 | 5.2 |
| 2 | 769 | 2.15 | 10.9 | 525 | 454 | 0.87 | 8.5 | 8.9 |
| 3 | 758 | 2.10 | 13.5 | 522 | 670 | 1.28 | 15.3 | 38.2 |
| 4 | 765 | 2.11 | 11.0 | 527 | 896 | 1.70 | 46.9 | 72.3 |

Embodiments

First embodiment: A tissue product comprising a plurality of separably joined sheets, the product having a cross-machine direction (CD) tensile less than about 1,000 g/76.2 mm, and a ratio of detach strength, having units of grams, to CD tensile less than 0.65.

Second embodiment: The tissue product of the first embodiment wherein the product has a basis weight from about 10 to about 60 grams per square meter and a sheet bulk from about 3 to about 25 cubic centimeters per gram (cc/g).

Third embodiment: The tissue product of the first or second embodiments wherein the product has a CD tensile from about 400 to about 1,000 g/76.2 mm.

Fourth embodiment: The tissue product of any one of the first through third embodiments wherein the product has a tensile ratio from about 1.5 to about 2.0.

Fifth embodiment: The tissue product of any one of the first through fourth embodiments wherein the product has a detach strength less than about 600 g.

Sixth embodiment: The tissue product of any one of the first through fifth embodiments wherein the product has a detach strength from about 100 to about 500 g.

Seventh embodiment: The tissue product of any one of the first through sixth embodiments wherein the product further comprises a plurality of spaced apart lines of perforations having a percent bonded area from about 10 to about 20 percent.

Eighth embodiment: The tissue product of any one of the first through seventh embodiments wherein the ratio of detach strength to CD tensile is from about 0.10 to 0.65.

Ninth embodiment: The tissue product of any one of the first through eighth embodiments wherein the product has a MD to CD tensile ratio from about 1.5 to about 2.0.

Tenth embodiment: The tissue product of any one of the first through ninth embodiments wherein the sheets are separated from one another by lines of perforations each comprising a plurality of individual apertures extending substantially from the first to the second side of the web and spaced apart from one another across the width of the web.

Eleventh embodiment: The tissue product of any one of the first through tenth embodiments wherein the sheets are separated from one another by lines of perforations having a percent bonded area from about 10 to about 20 percent.

Twelfth embodiment: The tissue product of any one of the first through eleventh embodiments wherein the product has a MD tear strength from about 10 to about 15 g.

Thirteenth embodiment: The tissue product of any one of the first through twelfth embodiments wherein the product has a ratio of detach strength, having units of grams (g), to MD tear strength, having units of grams (g), less than about 40, such as from about 20 to about 40 and more preferably from about 20 to about 30.

Fourteenth embodiment: The tissue product of any one of the first through thirteenth embodiments wherein the product has a ratio of MD to CD tensile greater than about 1.5.

What is claimed is:

1. A tissue product comprising a plurality of separably joined sheets, the product having a cross-machine direction (CD) tensile from about 400 to about 1,000 g/76.2 mm, a detach strength from about 100 to about 600 g, and a ratio of detach strength to CD tensile from about 0.10 to about 0.65.

2. The tissue product of claim 1 wherein the product has a basis weight from about 10 to about 60 grams per square meter (gsm) and a sheet bulk from about 3 to about 25 cubic centimeters per gram (cc/g).

3. The tissue product of claim 1 wherein the product has tensile ratio from about 1.5 to about 2.0.

4. The tissue product of claim 1 wherein the product has a detach strength from about 100 to about 500 g.

5. The tissue product of claim 1 wherein the product further comprises a plurality of spaced apart lines of perforations having a percent bonded area from about 10 to about 20 percent.

6. A rolled product comprising a spirally wound fibrous web having one or more plies, a first side, a second side, a length and a width, and a plurality of lines of perforations spaced apart from one another along the length of the web, the web having a CD tensile from about 400 to about 1,000 g/76.2 mm and a detach strength from about 100 to about 500 g, wherein the ratio of detach strength to CD tensile is less than 0.65.

7. The rolled product of claim 6 wherein the lines of perforations have a percent bonded area from about 10 to about 20 percent.

8. The rolled product of claim 6 wherein the spirally wound fibrous web has a CD tensile from about 400 to about 700 g/76.2 mm.

9. The rolled product of claim 6 wherein the spirally wound fibrous web has a detach strength from about 250 to about 450 g.

10. The rolled product of claim 6 wherein the fibrous web comprises a wet laid tissue web having geometric mean tensile (GMT) from about 700 to about 1,500 g/76.2 mm and a sheet bulk from about 3.0 to about 25 cc/g.

11. The rolled product of claim 10 wherein the wet laid tissue web is a single-ply uncreped, through-air dried (UC-TAD) tissue web.

12. The rolled product of claim 6 further comprising a core, wherein the web is spirally wound about the core.

13. A rolled product comprising a spirally wound tissue web having one or more plies, a first side, a second side, a length, a width, and a plurality of lines of perforations spaced apart from one another along the length of the web, the lines of perforations each comprising a plurality of individual apertures extending substantially from the first to the second side and spaced apart from one another across the width of the web, the web having a CD tensile from about 400 to about 1,000 g/76.2 mm, a detach strength from about 100 to about 500 g and a ratio of detach strength to CD tensile less than 0.65.

14. The rolled product of claim 13 wherein the lines of perforations have a percent bonded area from about 10 to about 20 percent.

15. The rolled product of claim 13 wherein the tissue web has a geometric mean tensile (GMT) from about 700 to about 1,500 g/76.2 mm and a sheet bulk from about 3.0 to about 25 cc/g.

16. The rolled product of claim 13 wherein the tissue web is a single-ply uncreped, through-air dried (UCTAD) tissue web.

17. The rolled product of claim 13 wherein the ratio of detach strength to CD tensile ranges from about 0.25 to about 0.60.

* * * * *